US005122938A

United States Patent [19]

Pastusek

[11] Patent Number: 5,122,938

[45] Date of Patent: Jun. 16, 1992

[54] TWIST SWITCH FOR FLASHLIGHT

[76] Inventor: Michael J. Pastusek, 2008 Martin Luther King Frwy.,, Ft. Worth, Tex. 76104

[21] Appl. No.: 653,028

[22] Filed: Feb. 8, 1991

[51] Int. Cl.[5] ..... F21L 7/00

[52] U.S. Cl. ..... 362/203; 362/205; 362/206

[58] Field of Search ..... 362/206, 203, 205, 202, 362/208, 157

[56] References Cited

U.S. PATENT DOCUMENTS

| | | | |
|---|---|---|---|
| 1,934,214 | 11/1933 | Stimson | 362/208 |
| 1,955,511 | 4/1934 | Muros | 362/206 |
| 2,619,559 | 11/1952 | Schenkel | 362/208 |
| 2,677,022 | 4/1954 | Fleming | 362/206 |
| 4,135,230 | 1/1979 | Armbruster | 362/206 |
| 4,905,129 | 2/1990 | Sharrah | 362/206 |
| 4,949,231 | 8/1990 | Wang | 362/206 |
| 5,006,969 | 4/1991 | Lai | 362/206 |

FOREIGN PATENT DOCUMENTS

| | | | |
|---|---|---|---|
| 662665 | 5/1963 | Canada | 362/205 |
| 2216998 | 10/1989 | United Kingdom | 362/203 |

*Primary Examiner*—Ira S. Lazarus
*Assistant Examiner*—Y. Quach
*Attorney, Agent, or Firm*—Charles D. Gunter, Jr.

[57] ABSTRACT

A twist switch is shown for a flashlight of the type having a conductive tubular body having an interior, opposing ends and an internal shelf formed at one of the opposing ends. The internal shelf has a bulb receiving opening and a reflector is mounted on the internal shelf. A bulb is inserted into the tubular body having a shoulder contact which rests on the internal shelf and a base contact which passes through a bulb receiving opening in the internal shelf. A dry cell battery is stationarily positioned within the interior of the tubular body and has a center terminal in electrical contact with the bulb base contact. An end cap is rotatably engaged on the end of the tubular body opposite the reflector. A conductor element located within the interior of the end cap is initially separated from the tubular body by an insulating member. Turning the end cap moves the end cap in the direction of the reflector end of the flashlight and causes the conductor element to contact the tubular body to complete and electrical circuit through the bulb, tubular body and battery.

7 Claims, 3 Drawing Sheets

TWIST SWITCH FOR FLASHLIGHT

BACKGROUND OF THE INVENTION

1. Field of the Invention

The present invention relates generally to portable flashlights and, more specifically, to an improved twist switch for establishing electrical contact between the flashlight bulb and a dry cell battery contained within the flashlight body.

2. Description of the Prior Art

Flashlights of varying sizes and shapes are well known in the art. A number of such designs are known which utilize two or more dry cell batteries, carried in series in a tubular body which serves as a handle for the flashlight, and as their source of electrical energy. Typically, an electrical circuit is established from one terminal of the battery through a conductor to an external switch and then through a conductor to one contact of a bulb. After passing through the filament of the lamp bulb, the electrical circuit emerges through a second contact of the lamp bulb in electrical contact with a conductor, which in turn is in electrical contact with the flashlight housing. The flashlight housing provides an electrical conduction path to an electrical conductor, generally a spring element, in contact with the other terminal of the battery. Actuation of the external switch to complete the electrical circuit enables electrical current to pass through the filament of the lamp bulb, thereby generating light which is typically focused by a reflector to form a beam of light.

A number of disadvantages result from the use of a switch mounted on the side of the tubular body of the flashlight. Such switches are easily damaged when subjected to severe environments. Switches of this type can also be turned on by accident, such as where vibration causes electrical contact. Because of the arrangement of internal components, the overall length of the flashlight is increased In order to overcome these shortcomings, a number of prior art designs are known in which an end cap is rotatably secured to the flashlight body, the end cap being rotated to establish the required electrical contact to illuminate the lamp bulb. A number of such prior art designs feature rotatable end caps which are rotated to cause longitudinal movement of the dry cell batteries within the flashlight body in the direction of the lamp bulb, thereby causing contact between the battery center terminal and the base contact of the lamp bulb. In the open position, the dry cell battery is typically spring biased away from the base contact of the bulb. Examples of such designs are shown, for instance, in U.S. Pat. Nos. 2,258,074; 2,435,689; 2,249,689; and 1,595,146.

In more recent improvements, miniature flashlights have been designed which feature a rotatable switch located in the reflector end of the flashlight body. The lamp bulb is located within an insulated receptacle at the reflector end of the flashlight with one or more conductive pins being rotatably aligned by movement of the switch portion of the device to establish electrical contact While the switch mechanisms are internal to the device and are thus less subject to damage, they are overly complicated in design and more costly to manufacture. Such designs are shown, for instance, in U.S. Pat. Nos 4,899,265; 4,916,588; 4,907,141; 4,864,474; and 4,658,336.

The present invention has as its object to provide an improved twist switch for a portable flashlight which is simple in design and economical to manufacture.

Another object of the invention is to provide such a switch which is not subject to accidental actuation due to vibration, or the like.

Another object of the invention is to provide an improved flashlight design which is shorter in overall length through the elimination of an external switch mounted on the side of the tubular body of the flashlight.

Another object of the invention is to provide a twist switch for a flashlight which is self-cleaning in operation.

SUMMARY OF THE INVENTION

The twist switch of the invention is embodied in a flashlight which includes a conductive tubular body having an interior, a longitudinal axis, opposing ends and an internal shelf formed at one of the opposing ends within the interior. The internal shelf has a central, bulb receiving opening communicating with the interior of the tubular body. A reflector is mounted on the internal shelf within the interior of the tubular body, thereby defining a reflector end for the flashlight. A bulb of the type having a shoulder contact rests on the internal shelf, the bulb also having a base contact which passes through the bulb receiving opening, thereby positioning the bulb in the opening relative to the reflector. At least one dry cell battery is stationarily positioned within the interior of the tubular body. The dry cell battery has a center terminal in electrical contact with the bulb base contact. The battery also has a case terminal. A metal end cap is rotatably engaged on the end of the tubular body opposite the reflector. A conductor element is located within the interior of the end cap and is initially separated from the tubular body by an insulating member. Turning the end cap moves the end cap along the longitudinal axis of the tubular body in the direction of the reflector end, thereby causing the conductor element to contact the tubular body and complete an electrical circuit through the bulb, tubular body and battery.

Preferably, the conductor element is a metallic disc which is seated upon the insulating member. The conductor element has a peripheral lip adapted to engage the tubular body when the end cap is moved longitudinally in the direction of the reflector end. The insulating member is preferably a non-conductive disc seated within the end cap interior. The insulating member has a peripheral lip of greater relative circumferential diameter than the peripheral lip of the conductor element, whereby the conductor element is initially separated from the tubular body The end cap can be provided with an internally threaded surface which is adapted to matingly engage an externally threaded surface on the end of the tubular body opposite the reflector end. A coil spring is preferably located within the end cap engaging the conductor element and the case terminal of the dry cell battery, the coil spring serving to spring bias the battery and end cap in opposing directions.

Additional objects, features and advantages will be apparent in the written description which follows.

DETAILED DESCRIPTION OF THE INVENTION

Figure 1:
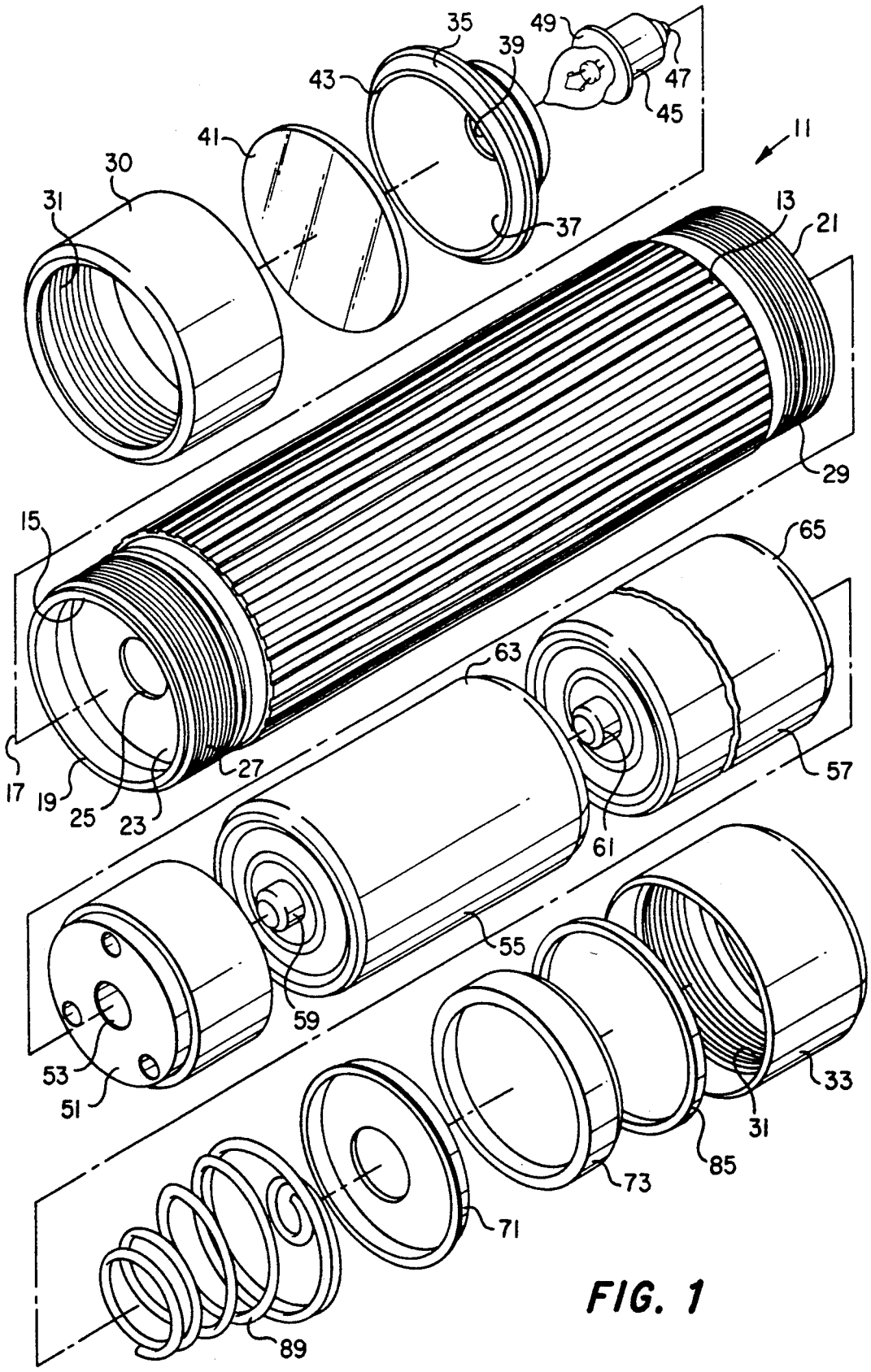
FIG. 1 is an exploded view of the flashlight of the invention featuring the improved twist switch.

FIG. 1 shows the flashlight of the invention in exploded fashion. The flashlight (designated generally as 11 in FIG. 1) includes a conductive, preferably metallic, tubular body 13 having an interior 15, a longitudinal axis 17 and opposing ends 19, 21. An internal shelf 23 having a central, bulb receiving opening 25 is formed at one of the opposing ends 19 within the interior 15. As shown in FIG. 1, the opening 25 communicates with the interior 15 of the tubular body 13.

Each of the opposing ends 19, 21 is provided with an externally threaded surface 27, 29, the threaded surface 27 being adapted to engage a globe housing 30, while the threaded surface 29 is adapted to engage the mating internally threaded surface 31 of an end cap 33.

A reflector 35 having an internally reflective surface 37 is provided with a bulb opening 39 at the apex thereof, the opening also being aligned with the bulb opening 25 provided on the internal shelf 23 of the tubular body 13.

Transparent lens 41 of glass, plastic or other suitable material rests upon an outer edge 43 of the reflector 35 when the reflector 35 is assembled within the globe housing 30 and the housing 30 is threadedly engaged with the reflector end of the tubular body 13.

A lamp bulb 45 of the type having a base contact 47 and having a shoulder contact 49 is supported on the internal shelf 23 with the base contact 47 passing through the bulb receiving opening 25, thereby positioning the bulb in the opening relative to the reflector 35.

A non-conductive spacer element 51 can be located within the interior 15 of the tubular body 13 below the internal shelf 23. The spacer element 51 has a central opening 53 aligned with the reflector opening 39 and the bulb receiving opening 25 of the tubular housing 13 for receiving the base of the bulb 45. The central opening of the spacer element 51 terminates in a contact opening 55 (FIG. 2) for exposing the bulb base contact 47 to the lower interior 56 of the tubular body below the internal shelf 23.

Figure 2:
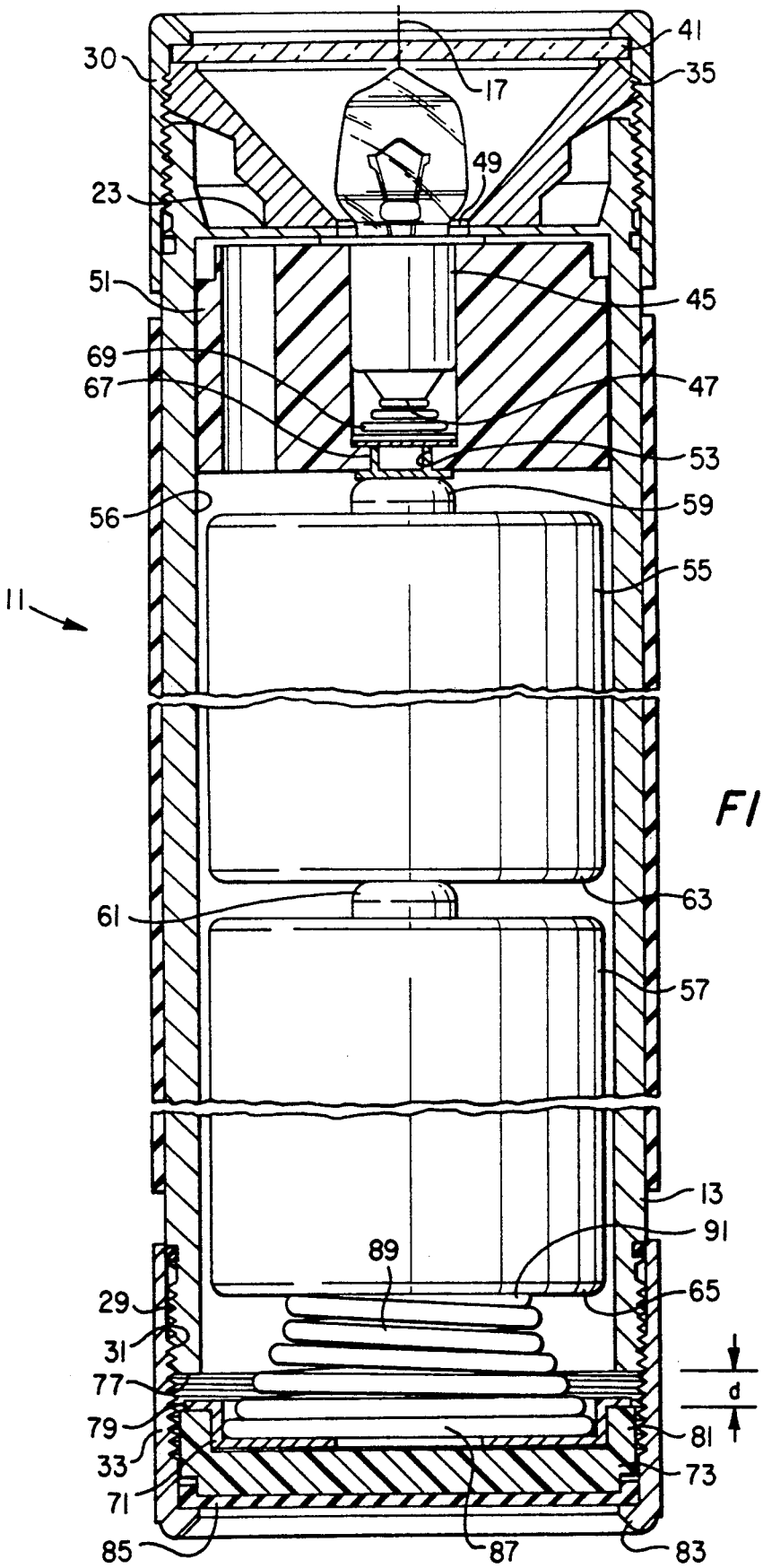
FIG. 2 is a side, cross-sectional view of the assembled flashlight of FIG. 1 showing the twist switch in the open position.

At least one dry cell battery is stationarily positioned within the interior 15 of the tubular body 13. Preferably, at least two dry cell batteries 55, 57 are provided. Each battery 55 has a center terminal 59, 61, the terminal 59 being in electrical contact with the bulb base contact 47 in the embodiment of FIGS. 2 and 3. Each battery also has a case terminal 63, 65. As shown in FIG. 2, the base contact 47 of the bulb 45 establishes contact with the center terminal 59 of the dry cell battery 55 by means of a metal retaining clip 67 and a coil spring 69.

Figure 3:
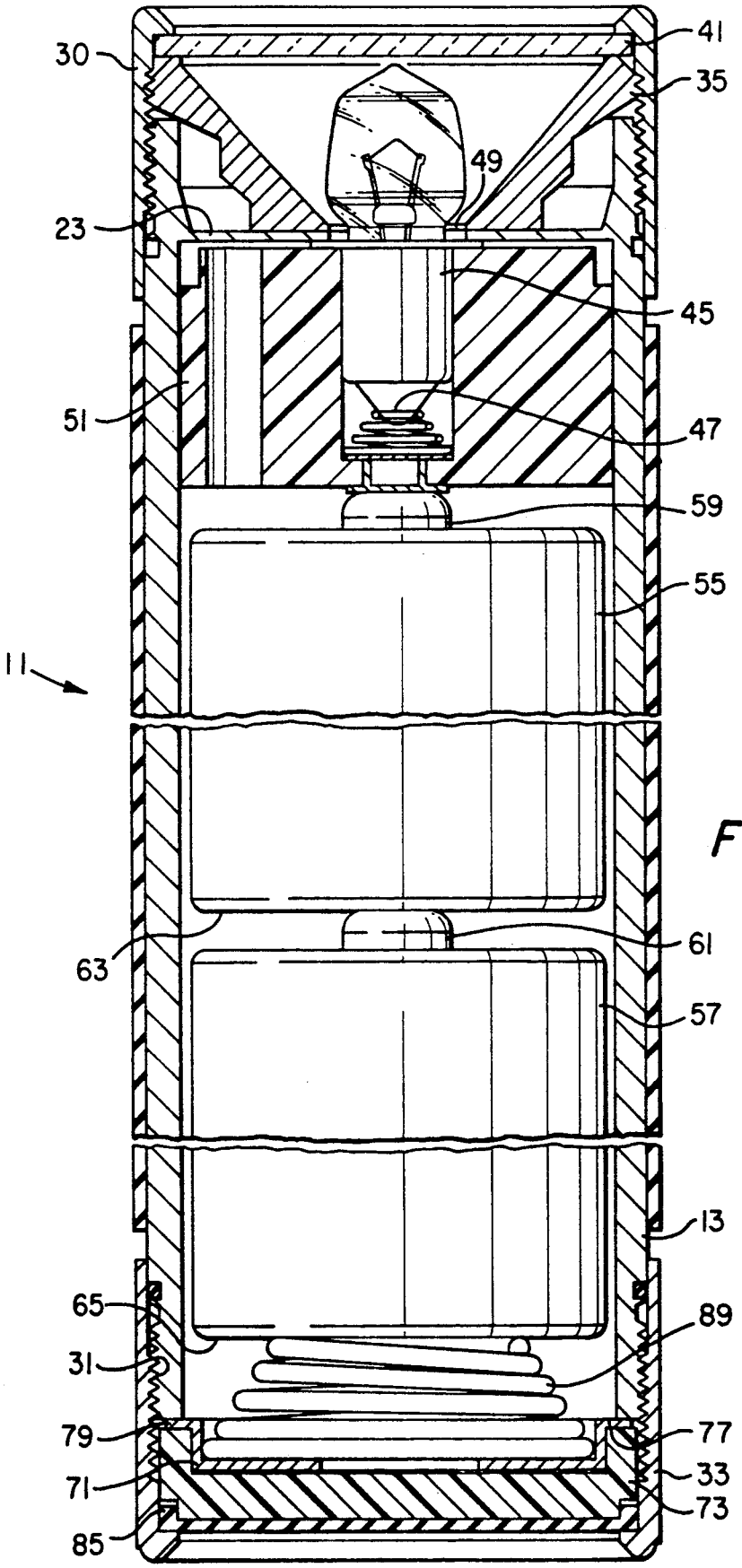
FIG. 3 is a cross-sectional view similar to FIG. 2 showing the twist switch in the closed position.

As best seen in FIGS. 2 and 3, the internally threaded surface 31 of the end cap 33 rotatably and matingly engages the externally threaded surface 29, whereby the end cap can be twisted along the longitudinal axis of the flashlight in the direction of the reflector 35. A conductor element 71 is located within the interior of the end cap 33 and is initially separated from the end cap by an insulating member 73 and from the tubular body 13 by a distance indicated as "d" in FIG. 2.

A coil spring 89 engages the conductor element 71 within the end cap 33 and engages the case terminal 65 of the dry cell battery 57. The coil spring serves to spring bias the batteries 55, 57 and end cap 31 in opposing directions. The coil spring 89 also initially biases the conductor element 71 away from the tubular body 13. As shown in FIGS. 2 and 3, turning the end cap 33 along the longitudinal axis 17 of the tubular body 13 in the direction of the reflector 35 causes the conductor element 71 to move from the open position of FIG. 2 to the closed position of FIG. 3 thereby contacting the lower most extent 77 of the tubular body 13 to complete an electrical circuit through the bulb, batteries and tubular body.

Preferably, the conductor element 71 is a metallic disc which is seated upon the insulating member 73, the conductor element 71 having a peripheral lip 79 adapted to engage the lower most extent 77 of the tubular body 13 when the end cap is moved longitudinally in the direction of the reflector end of the flashlight.

The insulating member 73 is a non-conductive disc seated within the end cap interior. The insulating member can also be provided with a peripheral lip 81 of greater relative circumferential diameter than the peripheral lip 79 of the conductor element 71, whereby the conductor element 71 is initially separated from the tubular body As can be seen in FIGS. 2 and 3, the peripheral lip 79 of the metallic conductor element 71 forms a raised flange about the periphery of the metallic disc. The flange defines a recess for receiving coil spring 89, wherein a lower end 87 of the coil spring 89 is received within the recess so defined, the opposite end 91 of the coil spring 89 being in contact with the case terminal 65 of the battery 57.

In the embodiment of the device shown in FIGS. 2 and 3, the end cap 33 has an end opening 83 which is closed by means of a disc element 85 located within the end cap interior beneath the insulating member 73.

The operation of the flashlight of the invention will now be described. FIG. 2 shows the flashlight with the twist switch in the open position and the lamp bulb 45 turned off. The shoulder contact 49 of the bulb contacts the internal shelf 23 of the tubular body 13, thereby forming a path for the flow of electrical current through the tubular body 13. The bulb base contact is in contact with the center terminal 59 of the dry cell battery 55 and the base contact 65 of the lower most battery is in contact with the conductor element 71 through the coil spring 89. However, the conductor element 71 is initially separated from the tubular body 13 by the distance "d" in FIG. 2, breaking the electrical circuit.

In order to turn the switch to the on position, the end cap 33 is rotated in the direction of the reflector end 35, thereby causing the peripheral lip 79 of the conductor element 71 to contact the lower most extent 77 of the tubular body 13, thereby completing the electrical circuit between the bulb, tubular body and batteries.

An invention has been provided with several advantages. The twist switch of the invention is simple in design and economical to manufacture. The switch is not subject to accidental actuation due to vibration, or the like. The threaded engagement of the end cap and tubular body furnish a positive locking feature when the light is turned to the on position. The switch design is extremely durable and self-cleaning in nature. The absence of an external switch on the side of the tubular body or the use of excessive internal switch components within the sidewalls of the tubular body allow a flashlight to be designed with a shorter overall length.

While the invention has been shown in only one of its forms, it is not thus limited but is susceptible to various changes and modifications without departing from the spirit thereof.

I claim:

1. A flashlight, comprising:

a conductive tubular body having an interior, a longitudinal axis, opposing ends, and an internal shelf formed at one of the opposing ends within the interior, the internal shelf having a central, bulb receiving opening communicating with the interior of the tubular body;

a reflector mounted on the internal shelf within the interior of the tubular body, thereby defining a reflector end for the flashlight;

a bulb of the type having a shoulder contact which rests on the internal shelf, the bulb also having a base contact which passes through the bulb receiving opening, thereby positioning the bulb in the opening relative to the reflector;

at least one dry cell battery stationarily positioned within the interior of the tubular body, the dry cell battery having a center terminal in electrical contact with the bulb base contact, the battery also having a case terminal;

an end cap rotatably engaged on the end of the tubular body opposite the reflector;

a conductor element located within the interior of the end cap and initially separated from the tubular body by an insulating member;

whereby turning the end cap moves the end cap along the longitudinal axis of the tubular body in the direction of the reflector end, thereby causing the conductor element to contact the tubular body and complete an electrical circuit through the bulb, tubular body and battery;

wherein a coil spring is located within the end cap engaging the conductor element and the case terminal of the dry cell battery, the coil spring serving to spring bias the battery and end cap in opposing directions;

wherein the conductor element is a metallic disc which is seated upon the insulating member, the conductor element having a peripheral lip adapted to engage the tubular body when the end cap is moved longitudinally in the direction of the reflector end; and wherein the insulating member is a non-conductive disc seated within the end cap interior, the insulating member having a peripheral lip of a greater relative circumferential diameter than the peripheral lip of the conductor element, whereby the conductor element is initially separated from the tubular body.

2. The flashlight of claim 1, wherein the end cap has an internally threaded surface which is adapted to matingly engage an externally threaded surface on the end of the tubular body opposite the reflector end.

3. The flashlight of claim 2, further comprising a spacer element located within the interior of the tubular body, the spacer element having a central opening aligned with the opening of the reflector for receiving the base of the bulb, the central opening terminating in a contact opening for exposing the bulb base contact within the interior of the tubular body.

4. A flashlight, comprising:

a metal, tubular body having an interior, a longitudinal axis and opposing ends, an internal shelf being formed at one of the opposing ends within the interior thereof, the internal shelf having central, bulb receiving opening communicating with the interior of the tubular body;

a reflector mounted on the internal shelf within the interior of the tubular body thereby defining a reflector end for the flashlight, the reflector also having a bulb opening aligned with the bulb opening of the internal shelf;

a bulb of the type having a base contact and having a shoulder contact which supports the bulb on the internal shelf with the base contact passing through the bulb receiving opening, thereby positioning the bulb in the opening relative to the reflector;

a non-conductive spacer element located within the interior of the tubular body below the internal shelf, the spacer element having a central opening aligned with the opening of the reflector for receiving the base of the bulb, the central opening terminating in a contact opening for exposing the bulb base contact within the interior of the tubular body;

at least one dry cell battery stationarily positioned within the interior of the tubular body, the dry cell battery having a center terminal in electrical contact with the bulb base contact, the battery also having a case terminal;

a metal end cap rotatably and threadedly engaged on the end of the tubular body opposite the reflector;

a conductor element located within the interior of the end cap and initially separated from the end cap and from the tubular body by an insulating member;

a coil spring engaging the conductor element within the end cap and engaging the case terminal of the dry cell battery, the coil spring serving to spring bias the battery and end cap in opposing directions, whereby turning the end cap moves the end cap along the longitudinal axis of the tubular body in the direction of the reflector end, thereby causing the conductor element to contact the tubular body and complete an electrical circuit through the bulb, battery and tubular body;

wherein the conductor element is a metallic disc which is seated upon the insulating member, the conductor element having a peripheral lip adapted to engage an internal surface of the tubular body when the end cap is moved longitudinally in the direction of the reflector end; and wherein the insulating member is a non-conductive disc seated within the end cap interior, the insulating member having a peripheral lip of a greater relative circumferential diameter than the peripheral lip of the conductor element, whereby the conductor element is initially separated from the tubular body.

5. The flashlight of claim 4, wherein the peripheral lip of the metallic disc forms a raised flange about the periphery of the metallic disc which defines a recess, for the coil spring, and wherein one end of the coil spring is received within the recess so defined, the opposite end of the coil spring being in contact with the case terminal of the dry cell battery.

6. The flashlight of claim 5, wherein the end cap has an internally threaded surface which is adapted to matingly engage an externally threaded surface on the end of the tubular body opposite the reflector end.

7. A flashlight, comprising:

a conductive tubular body having an interior, a longitudinal axis, opposing ends, and an internal shelf formed at one of the opposing ends within the interior, the internal shelf having a central, bulb receiving opening communicating with the interior of the tubular body;

a reflector mounted within the interior of the tubular body, thereby defining a reflector end for the flashlight;

a bulb of the type having a shoulder contact, the bulb also having a base contact which passes through the bulb receiving opening, thereby positioning the bulb in the opening relative to the reflector;

at least one dry cell battery stationarily positioned within the interior of the tubular body, the dry cell battery having a center terminal in electrical contact with the bulb base contact, the battery also having a case terminal;

an end cap rotatably engaged on the end of the tubular body opposite the reflector;

a conductor element located within the interior of the end cap and initially separated from the tubular body by an insulating member;

whereby turning the end cap moves the end cap along the longitudinal axis of the tubular body in the direction of the reflector end, thereby causing the conductor element to contact the tubular body and complete an electrical circuit through the bulb, tubular body and battery;

wherein a coil spring is located within the end cap engaging the conductor element and the case terminal of the dry cell battery, the coil spring serving to spring bias the battery and end cap in opposing directions;

wherein the conductor element is a metallic disc which is seated upon the insulating member, the conductor element having a peripheral lip adapted t engage the tubular body when the end cap is moved longitudinally in the direction of the reflector end; and wherein the insulating member is a non-conductive disc seated within the end cap interior, the insulating member having a peripheral lip of a greater relative circumferential diameter than the peripheral lip of the conductor element, whereby the conductor element is initially separated from the tubular body.

* * * * *